United States Patent [19]

Schweikert

[11] Patent Number: 5,052,284

[45] Date of Patent: Oct. 1, 1991

[54] AIR OUTLET

[75] Inventor: Wolfgang Schweikert, Stolberg, Fed. Rep. of Germany

[73] Assignee: H. Krantz GmbH & Co., Aachen, Fed. Rep. of Germany

[21] Appl. No.: 566,562

[22] Filed: Aug. 13, 1990

[30] Foreign Application Priority Data

Aug. 18, 1989 [DE] Fed. Rep. of Germany ..... 3927227

[51] Int. Cl.[5] ..... F24F 13/06

[52] U.S. Cl. ..... 98/40.05; 98/40.18

[58] Field of Search ..... 98/40.01, 40.05, 40.18

[56] References Cited

U.S. PATENT DOCUMENTS 1,032,912 7/1912 Killpatrick ..... 98/40.18 X 2,140,055 12/1938 Perkins ..... 98/40.18 X

FOREIGN PATENT DOCUMENTS 1153872 12/1967 Fed. Rep. of Germany .

449208 6/1936 United Kingdom ..... 98/40.01

*Primary Examiner*—Harold Joyce

*Attorney, Agent, or Firm*—W. G. Fasse

[57] ABSTRACT

For achieving a steady air flow into a room out of an air outlet, an outlet housing that can be attached to or suspended from the ceiling area of the room to be ventilated and/or air conditioned, has a top wall equipped with a vertically aligned air supply connector concentric to or centrally on the ceiling facing top wall of the housing. The connector is connected to an air supply duct. The open end sides of the housing form exhaust openings for the air that is to be guided into the room. At least two side walls of the housing each have a curved guide body or guide element that is so constructed that the free air outflow cross-section from the outlet area of the supply connector to both exhaust openings has a Laval nozzle shape. The guide elements themselves can be formed and interconnected to form the nozzle and the housing simultaneously.

9 Claims, 2 Drawing Sheets

FIG.3
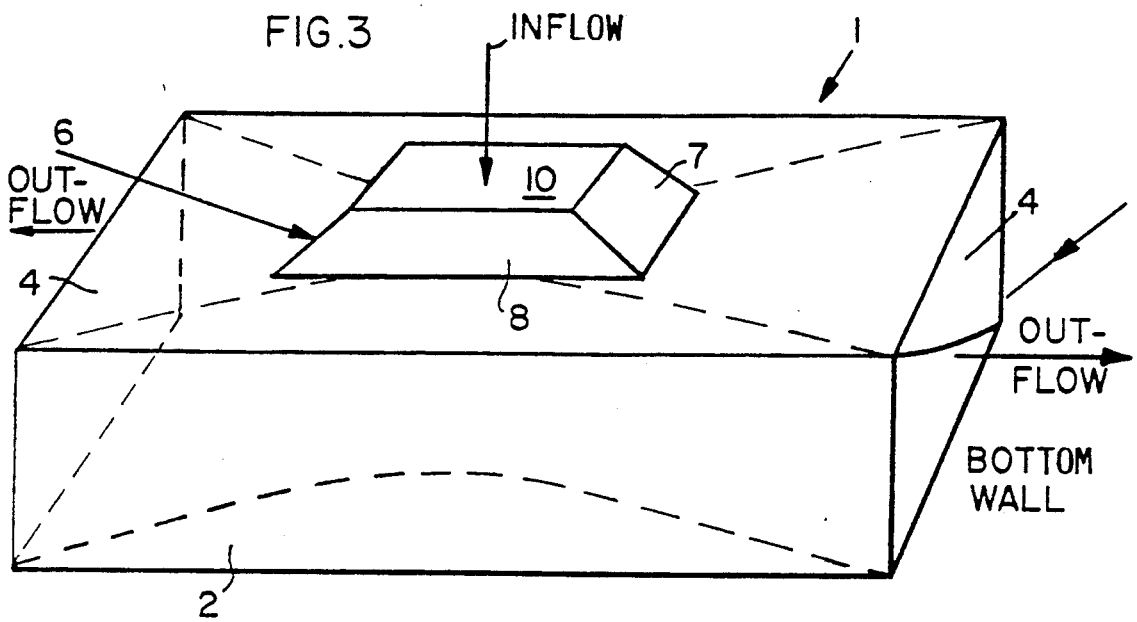
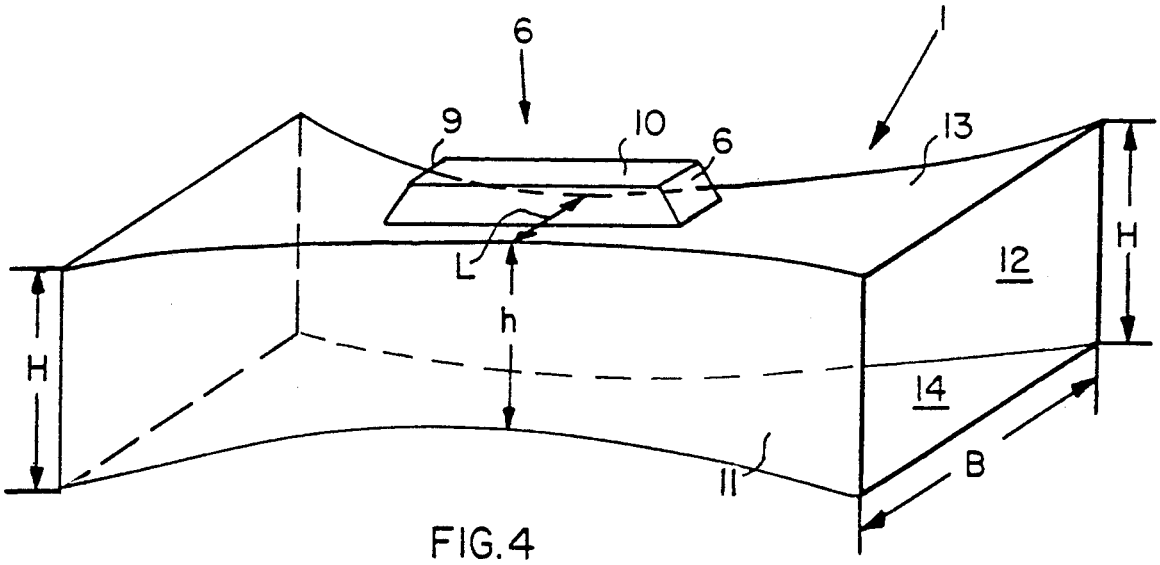
FIG.4
$H > h$ ; $B > b$

AIR OUTLET

FIELD OF THE INVENTION

The invention relates to an air outlet having a housing that can be attached to the ceiling area of a room that is to be ventilated and/or air conditioned.

BACKGROUND INFORMATION

Air outlet housings of this type are equipped with a vertically aligned air supply connector that is connected to an air supply duct. The supply connector is concentrically or centrally located on the ceiling side of the housing. The open front or outlet sides of the housing form exhaust openings for the air that is to be guided into the room.

Such an air outlet is known from DE-PS 1,153,872. It is the purpose of such air outlets to achieve a steady flow into the room to be cooled or ventilated when a demand for cooling or ventilating occurs. For this purpose the known outlet aims at making the air that is to be guided into the room, turbulent in the outlet housing.

It is not always possible to achieve a sufficient air flow stability by means of the known air outlet when a cooling demand occurs. Changes in volume of air flow or temperature differences in the air flows can cause the cold air stream to break into the area of the room occupied by people when the room is to be ventilated and/or air conditioned. When the air stream reaches such occupied area already 3 to 5 m away from the air outlet with an increased air velocity, an undesirable draft is generated.

OBJECTS OF THE INVENTION

In view of the foregoing it is the aim of the invention to achieve the following objects singly or in combination:

to construct an air outlet as described above, so that a steady or stable guiding of the flow of air is always possible when there is a cooling or ventilating demand;

to guarantee a steady flow of air even if there is a temperature difference of up to 10°K between the room temperature and the supply air temperature;

to avoid fundamental alterations in the construction of the conventional air outlet, so that its production will remain simple and inexpensive, and so that the new outlet can be used for reconstruction and improvement work in existing buildings;

available tools for the production of such outlets should remain in use; and any indispensable reconstruction of such air outlets must not lead to a serious reduction in acoustical and draft free qualities of a room equipped with the present air outlets.

SUMMARY OF THE INVENTION

According to the invention there is provided an air outlet in which the incoming air passing through the supply or air inlet connector, is guided through a Laval nozzle air guide means to the air exit openings.

The Laval nozzle forms a double horn outlet, extending in opposite directions from the air inlet connector to the air exit openings facing in opposite directions. The horn type air guide elements formed by the Laval nozzle may be so constructed that these air guide elements themselves form an air outlet housing. In another embodiment, the air guide elements are mounted inside a separate housing. The use of a separate housing is more convenient where installation considerations must take into account an existing ceiling grid pattern to which the air outlet housings must be matched.

A pronounced steady or more stable air flow in case of a cooling or ventilating demand is achieved through the Laval nozzle air guide means of the invention, in a free-flowing arrangement and in an outlet arrangement attached to the ceiling. When the outlet top wall is directly flush with the ceiling, rather than suspended from the ceiling, the upper edges of the air outlet openings are contacting the ceiling and the air inlet connector is recessed in the ceiling. In both instances the free air guide flow cross-section increases from the outlet area of the air supply connector through the Laval nozzle formed by curved guide elements which in turn form two exit openings.

Tests performed with air outlets of this invention had the following results. The outlet was charged at different times with three air streams of different volumes: 400 $m^3/h$, 700 $m^3/h$, 1000 $m^3/h$. The difference between the room temperature and the inlet air temperature was 7.5°K. The outlet was so installed, that on one side the upper outlet edge was flush with the ceiling, while the other side was below the ceiling, so that an air flow guided by the ceiling and on the other side a free-flowing air flow could be observed. For all three volume conditions a steady air flow was achieved. The air jets were no longer diverted at a point 3 to 5 m away from the outlet into the area occupied by people. In connection with the ceiling flush mounting of the test arrangement absolutely no drop of the air jets into the occupied room area was detected. In the free-flow mounting of the test arrangement below the ceiling, the reach or range of the fresh air was considerably increased. The supply air flow was gradually diverted downwardly only after about 9 m away from the respective outlet opening. At this distance the velocity of the air jets or air flow had been so reduced that no draft was noticeable in the occupied room area.

The air flow characteristic also did not change when the air outlet opening of the present swirling air outlet away from the ceiling was opened and the other opening flush with the ceiling, was simultaneously closed. In order to ascertain the differences in the air flows with and without guide elements, the guide elements were inserted into an outlet housing as curved guide bodies, which were temporarily removed to ascertain their operation or effectiveness. The improvements could be directly observed by comparing the air distribution achieved with the original arrangement, with the air distribution obtained by the guide elements under equivalent test conditions. When the guide elements were removed, the air flow was diverted downwardly immediately upon leaving the outlet housing. p As the tests have shown, simply swirling or making turbulent the air supply inside the outlet housing does not achieve the desired goal. With the insertion of the curved guide bodies of the invention, the inside of the outlet housing has a shape similar to that of a Laval nozzle, whereby the air stream or air jet impulse is increased and the formation or bunching of individual air streams into a single wide air beam is suppressed. This feature considerably increases the dropping range or reach of the air coming out of the outlet openings, whereby a natural reduction in the velocity of the air streams is achieved, so that the air streams can arrive in the occupied room area without any indication of a draft.

The introduction of the curved air guide bodies into the outlet housing provides a simple auxiliary means to achieve the objects of the invention without the need for any further measures. Thus, even existing air outlet housings can be outfitted with the present air guide bodies formed as Laval nozzle.

According to further embodiments of the invention, the bottom sides and/or the top or ceiling sides of the air outlet housing can be equipped with a curved guide body forming Laval nozzles or the guide bodies can be assembled as Laval nozzles of rotational symmetry, whereby the cross-sectional flow area has a circular cross-section.

According to further embodiments of the invention, the guide bodies in the form of Laval nozzles can comprise the side walls as well as the bottom and ceiling walls of the air outlet housing or the housing itself is made of flat sheet-metal components for encasing the curved sheet-metal guide bodies or guide elements.

BRIEF DESCRIPTION OF THE DRAWINGS

In order that the invention may be clearly understood, it will now be described, by way of example, with reference to the accompanying drawings, wherein:

FIG. 3 is a perspective view of the air outlet of FIG. 1, wherein air guide sheet metal elements are inserted into a rectangular box housing; and FIG. 4 is a perspective view of a modified air outlet of the invention, wherein the sheet metal air guide elements simultaneously form the outlet housing.

DETAILED DESCRIPTION OF PREFERRED EXAMPLE EMBODIMENTS AND OF THE BEST MODE OF THE INVENTION

Figure 1:
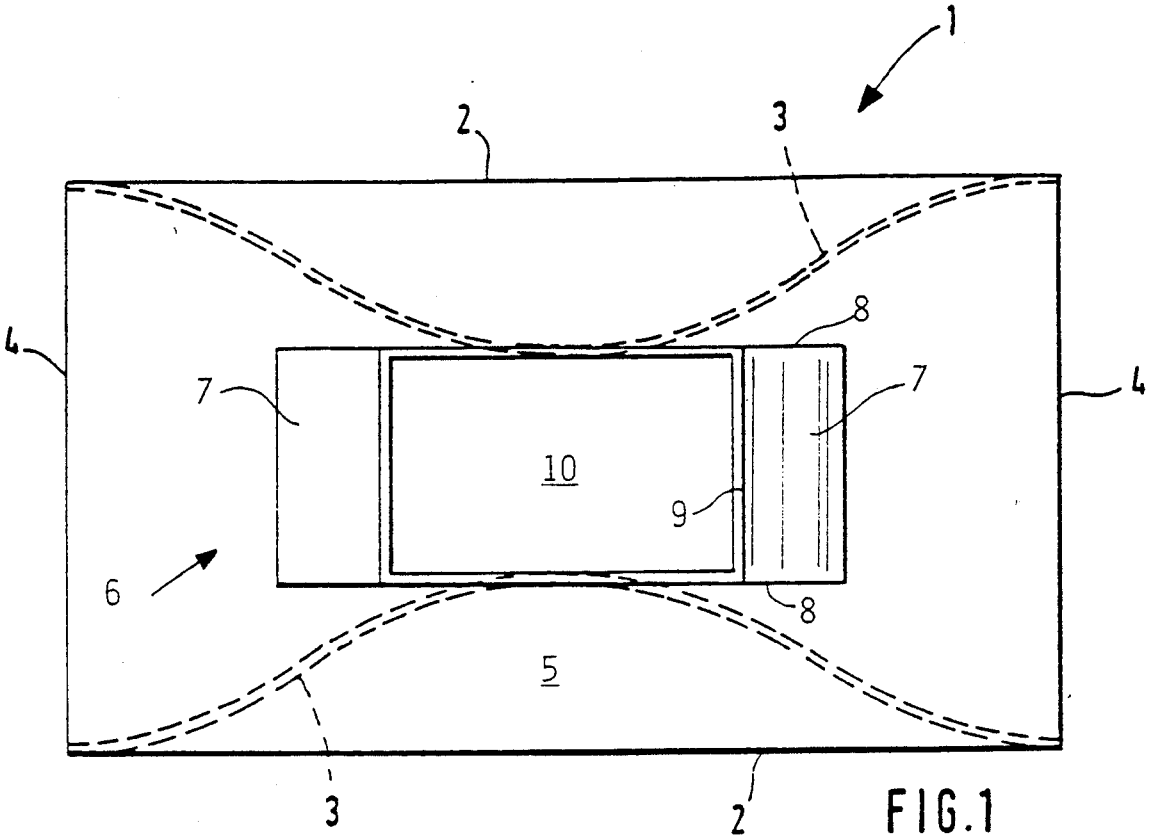
FIG. 1 is a plan view of one embodiment of an air outlet according to the invention, wherein the view direction is into the outlet in the direction of the air flow into the outlet.

FIG. 1 shows an air outlet formed by a housing 1, for example, of sheet metal, having side walls 2, a top wall 5, and a bottom wall away from the viewer. These walls 2, form a rectangular box with end openings 4 through which air exits into a room in which these boxes are installed either with the top wall 5 flush with the ceiling or suspended from the ceiling.

An air inlet connector 6 having funnel forming slanted end walls 7 and side walls 8 is connected to the top wall 5. The connector 6 has a connector flange or rim 9 for connection to an air supply duct not shown. According to the invention two curved air guide bodies 3 form a Laval nozzle between the two side walls 2, whereby the flow cross-section of the housing 1, or rather of the Laval nozzle, diverges toward both exhaust openings or air outlets 4 and converges toward the inlet opening 10 formed by the inlet connector 6.

Figure 2:
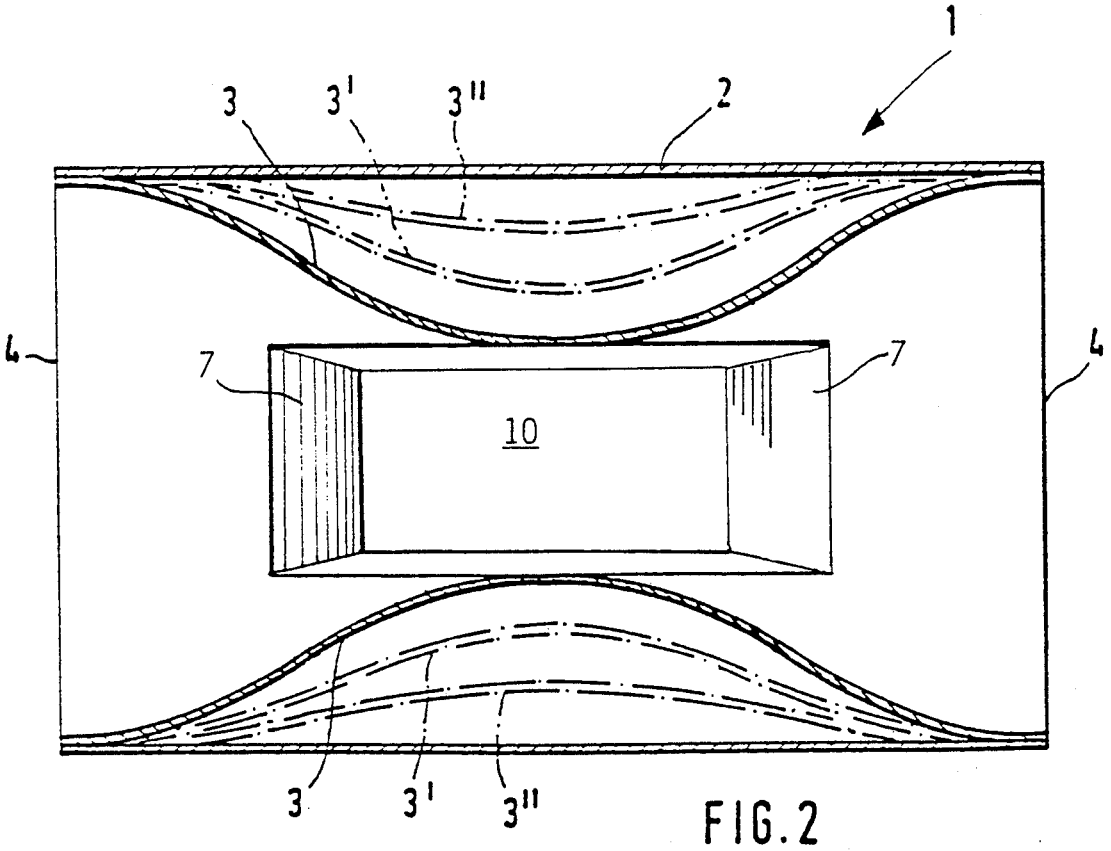
FIG. 2 is a sectional view of an outlet similar to that of FIG. 1, whereby the section plane extends parallel to a ceiling and the view direction is opposite to the air inflow direction.

This diverging and converging is typical of a Laval nozzle and assures that a tangent at the outlet of the Laval nozzle and a tangent at the inlet throat of the Laval nozzle extend in parallel to a central longitudinal axis of the Laval nozzle as is apparent, for example, from FIGS. 1 and 2, wherein the walls form the respective tangents.

The air guide bodies 3 may be sheet-metal elements bent into the appropriate shape and secured to the side walls 2, e.g., by welding, riveting, or the like. These guide bodies 3 may also be inserts, e.g., in molded foam bodies having a smooth air guide surface and glued to the inner surfaces of the side walls 2 and/or to the top and bottom walls.

FIG. 2 shows an air outlet that differs from the outlet depicted in FIG. 1, only insofar as to illustrate several curved sheetmetal guide bodies 3, 3' and 3'' having different curvatures to form different Laval nozzle configurations, especially different nozzle neck cross-sectional flow areas at the air inlet 10, whereby the depth of penetration or reach of the air streams into the room to be cooled or ventilated can be altered.

The perspective view of FIG. 3 illustrates the same elements as in FIG. 1. Hence, the same reference numbers are employed. FIGS. 1 and 3 show an embodiment in which the housing 1 is a separate structure for enclosing the air guide elements or bodies 3, 3', 3''. Incidentally, pairs of guide elements will be used and for a non-symmetrical air distribution even elements of different curvatures could be combined, e.g. element 3 on one side and element 3' on the other side.

FIG. 4 shows the embodiment in which the guide elements also form the housing which has a double horn type configuration in which the housing height H at the outlet ends 4 is larger than the housing height h at the center of the inlet connector 6. Further, the outlet width B is larger than the inlet width b at the center of the inlet connector 6.

An acoustical testing of the air outlet of the invention did not reveal any increase in the noise level in the room where the present outlets were installed compared to conventional outlets. Drafty air currents, moreover, were not noticed.

In FIG. 4, the side walls 11 and 12 are curved to form part of the nozzle configurations and also part of the housing. The top wall 13 and the bottom wall 14 have a necked down central section and otherwise are substantially plane, except for accommodating the condition $H > h$. However, the top wall 13 and the bottom wall 14 which form also guide elements and simultaneously part of the nozzle and of the housing, could also be curved.

Although the invention has been described with reference to specific example embodiments, it will be appreciated that it is intended to cover all modifications and equivalents within the scope of the amended claims.

What I claim is:

1. An air outlet for mounting to or from a ceiling, comprising housing means having a longitudinal central axis extending in an air outflow direction, air inlet means extending in a direction perpendicularly to said air outflow direction, said air inlet means being connectable to an air supply duct, air guide means forming a Laval nozzle in said housing means, said Laval nozzle having its converging nozzle neck below said air inlet means for supplying incoming air into said converging nozzle neck, said Laval nozzle diverging in said outflow direction from said converging nozzle neck toward at least one Laval nozzle outlet opening of said housing means, whereby a free cross-sectional flow area increases from said nozzle neck to said at least one outlet opening, and so that a tangent to said nozzle neck and a tangent to said outlet opening extend in parallel to said longitudinal central axis for a draft-free air supply.

2. The air outlet of claim 1, wherein said air guide means comprise air guide bodies forming lateral side walls of said housing means.

3. The air outlet of claim 1, wherein at least one of lateral side walls of said housing means is curved to form said Laval nozzle.

4. The air outlet of claim 1, wherein at least one of upper and lower walls of said housing means is curved to form said Laval nozzle.

5. The air outlet of claim 1, wherein said air guide means comprise curved air guide elements forming simultaneously walls of said housing means.

6. The air outlet of claim 5, wherein said curved air guide elements are sheet-metal members.

7. The air outlet of claim 1, wherein said housing means comprise plane housing walls, and wherein said air guide means comprise curved guide elements mounted in said housing means.

8. The air outlet of claim 7, wherein said plane housing walls and said curved air guide elements are sheet-metal members.

9. An air outlet for mounting to or from a ceiling, comprising double Laval nozzle means having a longitudinal central axis, a first air outlet facing in one direction of said central axis, a second air outlet facing in the opposite direction of said central axis, an air inlet between said air outlets, wall means enclosing a space between said first and second air outlets, said wall means diverging toward said air outlets and converging toward said air inlet to form a nozzle neck of said Laval nozzle means for introducing air into said air inlet in said nozzle neck and for supplying air into a room free of draft.

* * * * *